US006785393B2

(12) United States Patent
Lipponen et al.

(10) Patent No.: US 6,785,393 B2
(45) Date of Patent: Aug. 31, 2004

(54) AUDIO TRANSDUCERS

(75) Inventors: Markku Lipponen, Tampere (FI); Erkki Nokkonen, Tampere (FI); Janne Haavisto, Ruutana (FI)

(73) Assignee: Nokia Mobile Phones, Ltd., Espoo (FI)

( * ) Notice: Subject to any disclaimer, the term of this patent is extended or adjusted under 35 U.S.C. 154(b) by 598 days.

(21) Appl. No.: 09/727,221

(22) Filed: Nov. 30, 2000

(65) Prior Publication Data

US 2001/0002865 A1 Jun. 7, 2001

(30) Foreign Application Priority Data

Dec. 2, 1999 (FI) ..... 19992600

(51) Int. Cl.[7] ..... H04R 25/00
(52) U.S. Cl. ..... 381/191; 381/174; 381/388
(58) Field of Search ..... 381/306, 333, 381/113, 116, 191, 174, 388, 152; 367/170, 181

(56) References Cited

U.S. PATENT DOCUMENTS 4,352,961 A 10/1982 Kumada et al. ..... 179/110 A
5,007,707 A 4/1991 Bertagni ..... 350/118

FOREIGN PATENT DOCUMENTS

| | | | |
|---|---|---|---|
| FR | 2649575 | * | 1/1991 |
| WO | WO 95/20827 | | 8/1995 |
| WO | WO 96/35313 | | 11/1996 |

OTHER PUBLICATIONS

"The Flat Bubbles of Stretched Film", Kauppalehti, Mar. 24, 1998.

* cited by examiner

*Primary Examiner*—Huyen Le
(74) *Attorney, Agent, or Firm*—Perman & Green, LLP

(57) ABSTRACT

A device (MS) having an electrical display (DSPL) is equipped with a transparent electrostatic diaphragm (ACT) vibrateably attached in front of the display. The display has been made electrically conductive and used as a stator of thus formed electrostatic speaker (TD1). A fluctuating DC-voltage is conducted to the diaphragm and display in order to resonate the diaphragm and produce sound respective to the fluctuation. The transparency of the diaphragm allows a user to see the display through the diaphragm. Alternatively, the similar arrangement can be used to implement a transparent electrostatic microphone on the display.

12 Claims, 2 Drawing Sheets

AUDIO TRANSDUCERS

FIELD OF THE INVENTION

This invention relates to audio transducers.

BACKGROUND OF THE INVENTION

Many different information, entertainment and communication devices having displays have been designed. It is desirable to use such devices to present multimedia, generally in the form of images and sound. Accordingly, such devices require interfaces capable of presenting information both in audio and visual forms.

Personal computers can be used to present real-time multimedia, for example to function as video telephones so that a user is provided with both voice and image of a person with whom he or she talks. A typical personal computer comprises a microprocessor based central unit and a keyboard. The monitor usually comprises a casing containing a CRT (Cathode Ray Tube) typically having a diagonal dimension of at least 35 cm (14 inches). If the personal computer is configured to produce sound, it is convenient to locate a speaker on each side of the CRT either integrated into the monitor casing or provided as discrete units. The personal computer may also comprise a microphone. Integration of the speakers into the monitor casing facilitates initial connecting of peripherals to the computer.

The speakers typically used in these devices are dynamic speakers. Other types of speakers have been suggested. EP 847 670 discloses a CRT monitor which has electrostatic speakers in the form of panels integrated into either side of the monitor casing. The electrostatic speakers integrate a vibrating diaphragm and an actuator to vibrate the diaphragm. Thus, an actuating diaphragm actuates itself to vibrate. This provides a speaker with reduced thickness, but also reduces the length of the maximum movement of the diaphragm resulting in a lower acoustic power per unit area of the diaphragm. Locating such speakers on the sides of the monitor casing allows them to extend from the front of the monitor casing to the back, thus allowing the areas of the sides of the monitor casing to be used while causing only a small increase to its width. However, since the speakers are arranged facing outwardly rather than towards a user, this arrangement directs sound sideways rather than towards the front of the monitor.

In the future it is intended that multimedia should also be presented by mobile stations such as those used in cellular telecommunications systems. Multimedia presentation has been suggested particularly for mobile stations of the so-called third generation. The Nokia® 9110 communicator is an example of a mobile station presently used to present audio and video signals. This is a multifunction mobile station having two hinged parts. The parts open to reveal a QWERTY keyboard in one part for entry of alphanumeric text and a large LCD-display (Liquid Crystal Display) in the other part for displaying information to a user. This mobile station can wirelessly communicate using fax, e-mail and telephony services. It also allows hands-free (HF) telephone calls to be made using a built-in speaker and a microphone. The speaker is mounted inside the mobile station and sound is conveyed via a specific conduit to the open space surrounding the mobile station. The speaker and the conduit occupy space within the mobile station. Accordingly, in using a speaker arrangement of a particular size a compromise is made between audio quality and space consumption. In addition to the HF-speaker, there is another speaker associated with the earpiece. This further increases the space occupied within the mobile station, and furthermore requires holes to be provided in the mobile station's casing, which provides entry points for dust and moisture.

As the size of handheld mobile stations such as mobile phones and smart telephones is a limiting factor, it is necessary to select speakers for such devices to be as small as possible. The need to maintain good audio quality and provide a small speaker volume will increase in the future. Additional functionality required to implement the third generation of mobile stations will inherently lead to bigger mobile stations and/or shorter periods of idle time and talk times due to increased power consumption. There is a conflict between very limited size and relatively high power consumption. If the size is limited to a comfortable maximum, it may be too small to hold a sufficiently high-capacity battery, or vice versa, a high-capacity battery that can operate the device for a long period would require too much space. Therefore there is a desire to miniaturise components of mobile stations. However, as speakers are miniaturised, the small size impairs the audio response making reproduced speech and other audio signals difficult to understand and/or less pleasant to listen to.

SUMMARY OF THE INVENTION

According to a first aspect of the present invention, there is provided an audio transducer for changing a signal between an acoustic form and an electrical form, the audio transducer comprising an actuating diaphragm, a stator, and a support for supporting the actuating diaphragm adjacent to the stator, characterised in that both the actuating diaphragm and the stator comprise transparent material.

Advantageously, the audio transducer can be placed between a user and an object such as a screen without preventing the user from seeing the object, since the actuating diaphragm and the stator are transparent. This allows the transducer to be placed in front of objects that need to be seen.

According to a second aspect of the present invention, there is provided an audio-visual device comprising an optical device, and an audio transducer for changing a signal between an acoustic form and an electrical form, the audio transducer comprising an actuating diaphragm, a stator, and a support for supporting the actuating diaphragm adjacent to the stator, characterised in that both the actuating diaphragm and the stator comprise transparent material and the audio transducer is arranged adjacent to the optical device.

It is advantageous to combine a transparent audio transducer and an optical device. Thus, the very same area can be used to output or input image and to output or input sound or voice.

Preferably, the actuating diaphragm is arranged to vibrate in response to an electrical signal interacting with the actuating diaphragm to generate an acoustic response. Alternatively, the actuating diaphragm is arranged to vibrate in response to an acoustic signal interacting with the actuating diaphragm to generate an electrical response.

Preferably, the audio transducer is a speaker, a microphone, or a combination of both. In an embodiment of the invention in which the audio transducer is a transparent element disposed between a user and a display, this may provide a relatively large display surface area to be used as an acoustic element.

The optical device may be a mobile station, a mirror, a window, an electrical display, a solar cell, a touch screen or an illuminator. An electrical display is a display device comprising a screen, an input for receiving an electrical input signal and means for displaying on the screen texts or images corresponding to the electrical input signal.

Since the invention allows the surface area needed for a display to show information to be used for the audio transducer, a compact size of user interface device can be made with an audio transducer not smaller than the screen. This allows manufacture of smaller user interface devices and manufacture of user interface devices of ordinary size, but with an improved audio quality. Alternatively, if the optical device is a solar cell, then the surface of the solar cell can be used also to output sound, and efficiency of surface usage improves. If the audio response originates from the region of the optical device, the audio response appears, to a user, to come from the optical device. A display according to the invention used for video conferencing gives a realistic impression when the sound appears to come from the display. A rear-view mirror may be arranged to tell a user how far an object is behind a vehicle. A window of a shelf in an exhibition may tell about a particular exhibit.

Preferably, the audio-visual device is a mobile station further comprising a radio block for radio communication.

Preferably, the display is arranged to be visible through the actuating diaphragm.

An advantage of the invention is that the diaphragm of the transducer itself carries out the conversion between acoustic and electrical forms of signals. Dedicated movement conversion elements such as coils or magnets are not necessary. Thus, the transducer requires only a small depth in which the diaphragm may be located to vibrate. Additionally, providing the transducer on the outer surface of an optical device (adjacent to, for example, a display or a solar cell) makes it unnecessary to provide a sound-conveying conduit. This frees some space within the casing of the device for other components or allows manufacture of smaller devices without reducing functionality. A transducer provided by the invention has a relatively large surface, which also increases the maximum sound pressure when the transducer is used as a speaker and increases the sensitivity of the transducer when the transducer is used as a microphone. Furthermore, when the transducer is used as a speaker, sound appears to come from the image rather than from one side. Correspondingly, when the transducer is used as a microphone, a user is able to speak directly at the display and the transducer is able to receive the speech efficiently.

Preferably, the display is used as a stator for the actuating diaphragm. This reduces number of parts required.

Preferably, the actuating diaphragm is located between an outer protective diaphragm and the display so as to protect the actuating diaphragm from mechanical damage. In this case, the outer protective diaphragm allows a user to see through it. It may be transparent. Preferably the outer diaphragm is electrically conductive and arranged additionally to function as a stator for the actuating diaphragm. Preferably, the outer diaphragm is made of a material that allows sound waves to travel through itself in order that sound produced by the transducer is audible to a user of the audio-visual device. The outer protective diaphragm may be made of a porous material or provided with openings. Alternatively a grid could be used to protect the actuating diaphragm whilst also allowing the sound waves to be conveyed from the actuating diaphragm to space surrounding the audio-visual device.

Preferably, the actuating diaphragm is used to produce sound for an earpiece of an audio-visual device in addition to providing sound from the display.

According to a third aspect of the present invention, there is provided a method of producing an audio-visual response, wherein a transparent and electrostatic actuating diaphragm is arranged in a nominal position adjacent to an electrical display. The method comprises the steps of:

displaying an image on the electrical display, and feeding an electrical audio signal to the actuating diaphragm to cause it to vibrate in order to generate a sound.

Advantageously, the method gives a user an impression of sound originating from the electrical display.

According to a fourth aspect of the present invention, there is provided a method of manufacture of a device comprising a display, a speaker, and a transformer to drive the speaker, comprising the steps of:

attaching a transparent actuating speaker diaphragm adjacent to the display, and coupling the transparent actuating diaphragm to the transformer to drive the transparent actuating diaphragm as a sound producing vibrating element.

The present invention enables production of a compact and lightweight device by integration of a display and speaker so that they both occupy the same area. Therefore, there is no need to leave openings for a speaker in the casing of the device and penetration of dust and moisture into the device can be largely avoided. In addition, the production process becomes simplified, because separate openings need not to be made for arranging audiophonic access between the speaker and the space surrounding the device.

The present invention is applicable to devices such as mobile phones, electrical games, and wireless telephones, as well as to bigger devices such as laptop computers or displays for desktop computers. It is particularly suited to thin displays such as LCD—or electroluminescence displays. In general, the present invention may be used in applications where there is lack of space and a relatively large display is required.

BRIEF DESCRIPTION OF THE DRAWINGS

Embodiments of the invention will now be described, by way of example only, with reference to the accompanying drawings in which.

DETAILED DESCRIPTION

Figure 1:
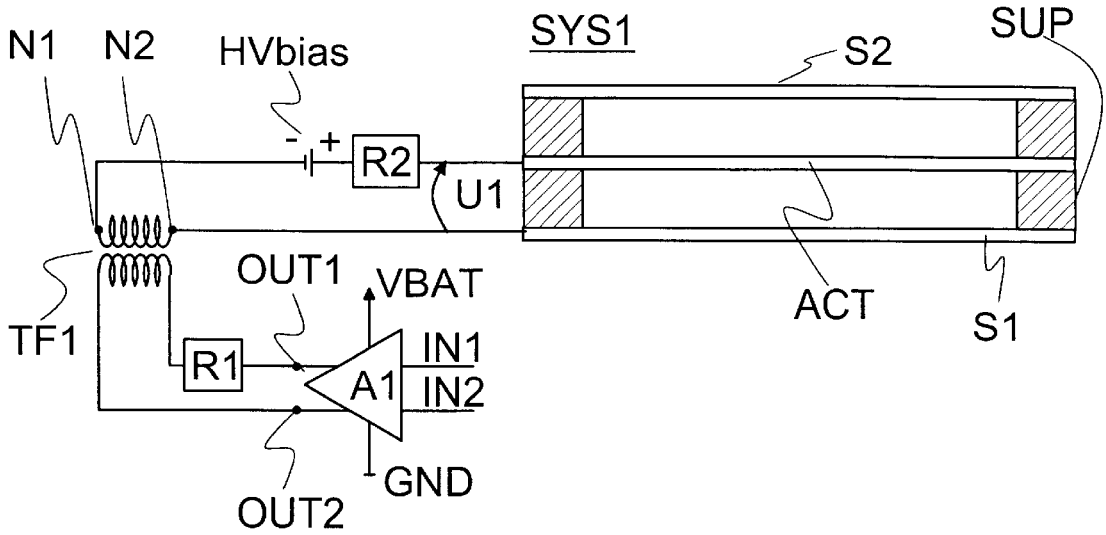
FIG. 1 shows a speaker arrangement according to the present invention.

FIG. 1 shows a speaker arrangement SYS1 according to the present invention. The speaker arrangement SYS1 is used with a display device having an electrical display. A display device in the form of a mobile station is described in relation to the later Figures. The arrangement comprises an electrostatic speaker having a transparent actuating diaphragm ACT (an actuator), a transparent stator S1 and an insulating support SUP holding the actuating diaphragm ACT and the stator S1 adjacent to each other. The stator S1 comprises an electrically conductive material, which is for example a coating on a display screen. The display screen is not shown in this embodiment. The stator S1 is in the form of an electrically conductive film integrated onto another surface of a display device using the speaker arrangement, for example, onto an electro-optical device such as a CRT, an LCD screen or a solar cell. The electrically conducting film may comprise indium or titanium oxide. Alternatively, the stator may carry on its surface a metallic grid of very thin wires to act as an electrically conductive element. This construction is known from electromagnetic compatibility covers.

The actuating diaphragm ACT is protected against mechanical damage by a guard S2 in the form of a thin metal grid. Alternatively it may be a transparent plastic diaphragm. All that is required of the guard is that it allows a user to look through it and see the display and allows the passage of sound waves.

In this embodiment of the invention in which a transparent speaker or microphone is arranged on the display, some of the light emanating from or reflected by the display should be able to pass through the speaker or microphone so that a user is able to see the display. In an embodiment of the invention in which a transparent speaker or microphone is placed in front of a solar cell, an audio transducer according to the present invention should allow the passage of some light through itself to allow the solar cell to transform solar energy into electricity. A suitable material for the actuating diaphragm is transparent Mylar™ polyester film that is manufactured by Du Pont. A suitable thickness is in the range of approximately 10 $\mu$m. Such a film is coated with a metal or similarly electrically conductive material. Such a film is known from the manufacture of polyester capacitors. MartinLogan has used chemically coated Mylar film in electrostatic speakers. The film is mounted whilst being stretched so as to leave a residual tension in the film. Electrically conductive plastics are known to a person skilled in the art.

The speaker arrangement SYS1 comprises a driving circuit for supplying a rapidly varying voltage across the actuating diaphragm and the stator. The driving circuit comprises an amplifier A1, a first resistor R1, an audio transformer TF1 having first and second output nodes N1 and N2, a DC voltage supply HVbias, and a second resistor R2.

Operation of a single ended speaker arrangement will now be described. The amplifier A1 is a differential amplifier having two inputs IN1 and IN2 for receiving low-voltage audio signals. The amplifier A1 also has a connection to ground GND and a connection to operating voltage VBAT (supplied by a battery) for receiving a supply voltage, and outputs OUT1 and OUT2 for providing an amplified audio signal. The first resistor R1 is used to limit the current in the amplifier A1 to protect it against excessive currents. After the first resistor R1 the audio signal is supplied to the audio transformer TF1 for boosting of the voltage of audio signal by a factor of approximately 50 in order to provide an output voltage of approximately 200 Volts peak to peak voltage. The first output node N1 of the audio transformer TF1 is coupled to a negative node of HV bias. A positive node of HV bias is connected to the actuating diaphragm ACT via the second resistor R2. The second output node N2 of the audio transformer TF2 is coupled to the stator S1. A high voltage power source HVbias coupled between the first node N1 and the second resistor R2 is used to maintain a constant charge in the speaker. The second resistor R2 has a high resistance and is connected in series with HVbias and ACT in order to guarantee a constant charge operation. The resistance of the second resistor R2 is in the range of 10 MΩ to 100 MΩ.

Initially there is equilibrium, wherein the actuating diaphragm ACT has a constant voltage and constant charge, and there is a voltage U1 between it and the stator S1. To generate sound the equilibrium is disturbed. An amplified audio signal changes the voltage of the stator S1 in relation to the voltage of the actuating diaphragm ACT. The balance of attractive and repulsive forces acting on the actuating diaphragm ACT due to S1 changes, the actuating diaphragm ACT moves and sound is thus generated. Tension within the actuating diaphragm ACT applies a return force back to its nominal position, that is an idle position where it was before the movement. The tension also acts to prevent the actuating diaphragm ACT from touching the stator S1.

The voltage required to drive the speaker depends on number of parameters, including the areas of the actuating diaphragm ACT and the stator S1, the gap between the actuating diaphragm ACT and the stator S1, the tension of the actuating diaphragm ACT, the intended sound pressure level (SPL), the desired frequency response and the level of HVBias voltage (SPL increases with increasing HVBias voltage). It should be understood that the areas and shapes of the actuator ACT and the stator S1 do not have to be identical nor do their electrical conductivities. In an embodiment in which the guard S2 is used, its sound dampening properties based on its shape, size, thickness, porosity, and the size and number of openings will have an effect, which will need to be taken into account. The sheet resistance (Ω/square) for the actuator may be for example 100 kΩ/square.

Figure 2:
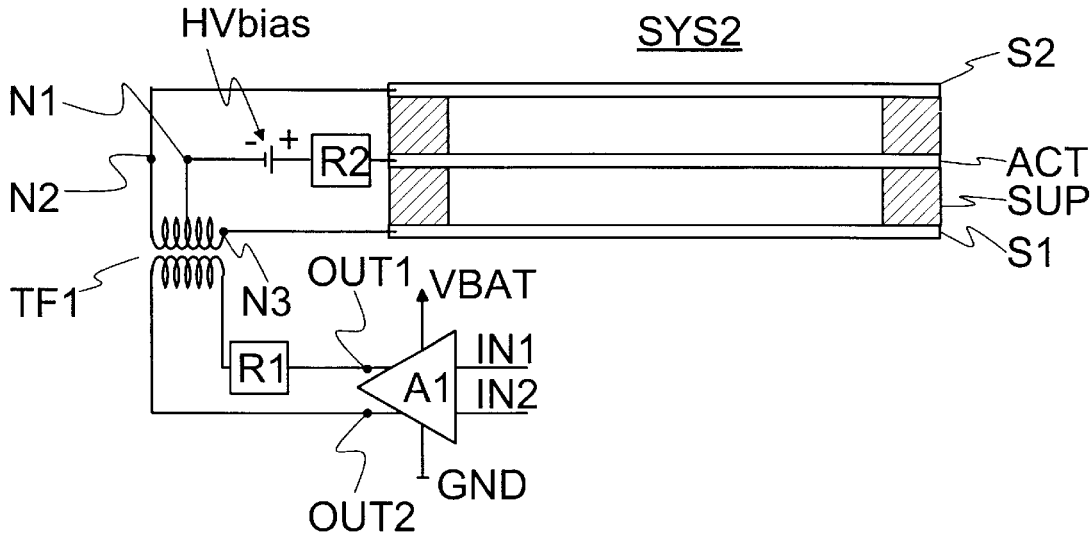
FIG. 2 shows another speaker arrangement according to the present invention.

FIG. 2 shows a speaker arrangement SYS2 according to a second embodiment of the present invention. The arrangement is similar to the first embodiment and corresponding reference signs have been applied to corresponding parts. In this embodiment, the guard S2 is used as a second stator to enhance driving of the actuating diaphragm ACT. This reduces distortion of sound and increases the sound pressure level SPL. In this two stator arrangement the first node N1 is an intermediate node which is present on the secondary coil of the transformer. The number of turns in the coil between N1 and N2 usually equals to the number of turns between N2 and N3. The nodes in the ends of the coil are denoted as N2 and N3. N3 is coupled to S1 and N2 is coupled to S2. Between N1 and ACT there is coupled in series the HVbias voltage and the resistor R2. In an alternative embodiment, an intermediate voltage is arranged with two equal capacitors or resistors connected in series between the nodes N2 and N3 of the transformer TF1. Then the voltage output corresponding to the node N1 will be available in the joint of the two capacitors or resistors. The HVBias voltage is connected to node N1 as described above.

The operation of the speaker arrangement SYS2 is similar to the operation of the speaker arrangement SYS1. The actuating diaphragm ACT has a constant voltage relative to the stators in an idle mode, that is when the speaker arrangement SYS2 is in operation but no sound is produced. Amplified audio voltages are applied across the two stators S1 and S2 so that the actuating diaphragm ACT experiences an attractive force towards one stator and a repulsive force towards another stator. Thus, the speaker arrangement SYS2 operates in a push-pull manner. A step change in the audio signal causes a simultaneous change in the attraction between S1 and ACT and in the repulsion between S2 and ACT.

Figure 3:
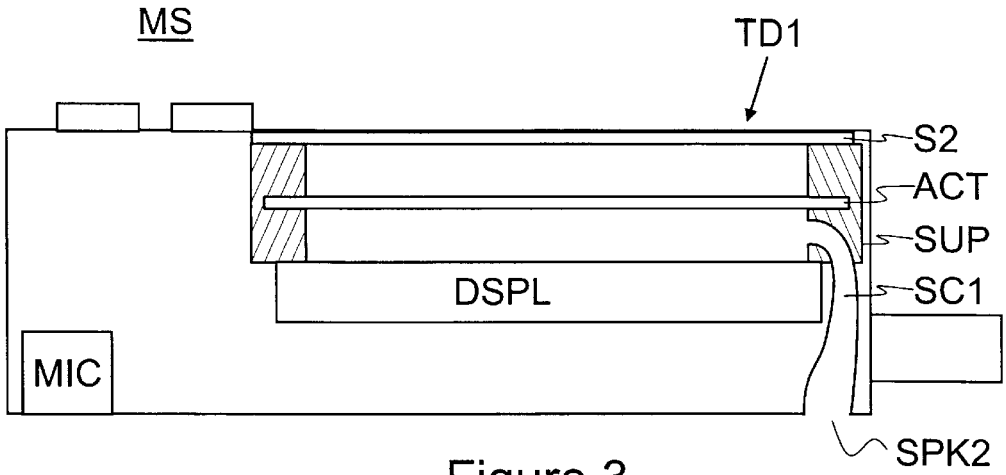
FIG. 3 shows a mobile station incorporating a display according to the present invention.

FIG. 3 shows a side view of a mobile station MS according to the present invention. The mobile station MS comprises the speaker arrangement of FIG. 2. Accordingly, corresponding reference signs have been applied to corresponding parts. A display DSPL is integrated inside the mobile station MS and its top surface functions as a stator.

An actuating diaphragm ACT is sandwiched between the guard S2 and the display DSPL so that there is a gap on both sides of the actuating diaphragm ACT leaving space for it to vibrate. A conduit SC1 leads from the gap between the actuating diaphragm ACT and the display DSPL. One end of the conduit SC1 opens into the space behind ACT and the other end opens into an opening on a side of the mobile station MS opposite the display DSPL. The arrangement provides a user with two different speakers, both of which use the same electronics and the same actuating diaphragm. The arrangement is even more suitable in a foldable two-part device, in which the display DSPL is located on an inner surface and thus contained within the device when it is closed. This reduces the projection of sound in a direction opposite to the direction of sound coming from the earpiece speaker SPK2. To hinder penetration of dust into the device, the conduit can be closed with a tense diaphragm extending across the conduit. The speaker makes air surrounding it to vibrate, and the air further makes the tense diaphragm to vibrate in the conduit. This diaphragm then transmits the vibration to the air on its other side thus passing the sound through itself.

Figure 4:
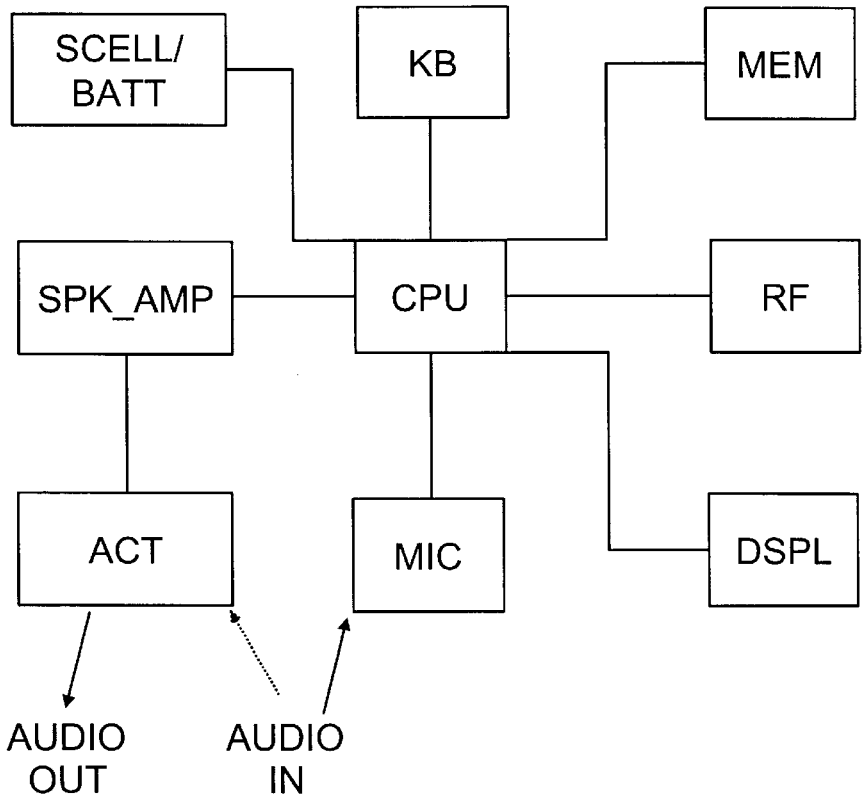
FIG. 4 shows a block diagram of the mobile station of FIG. 3.

FIG. 4 shows a block diagram of the mobile station of FIG. 3. The mobile station has a Master Control Unit MCU that may be a microprocessor, a Digital Signal Processor DSP or any other functionally similar unit. The MCU controls the other blocks of the mobile station. These blocks include an RF block for Radio Frequency processing of data and a memory block MEM comprising Random Access Memory (RAM) to store instructions to be executed by the MCU, a Read Only Memory ROM for conserving execution instructions in non-volatile memory, and non-volatile memory such as Flash-ROM or digital memory disk(s) which allows non-volatile and re-writeable conserving of data that may change, for example to store user information. The mobile station has an input means for receiving input from a user response, such as a keyboard KB. It also has both an electrical display DSPL and a solar cell SCELL for generating operating voltage for the mobile station and/or recharging a battery BATT of the mobile station. The electrical display DSPL is a low power-consuming device such as an LCD (Liquid Crystal Display).

Using the RF block, the mobile station can receive video images to be shown on the display DSPL. This allows the mobile station to present real-time multimedia, for example video conferencing.

This paper presents the implementation and embodiments of the invention with the help of examples. It is obvious to a person skilled in the art, that the invention is not restricted to details of the embodiments presented above, and that the invention can be implemented in another embodiment without deviating from the characteristics of the invention. Thus, the presented embodiments should be considered illustrative, but not restricting. For example when using the invention for monitors of computers or TV-screens it is natural that the display does not need to be of a low power consuming type such as an LCD screen. Hence, the possibilities of implementing and using the invention are only restricted by the enclosed patent claims. Consequently, the various options of implementing the invention as determined by the claims, including the equivalent implementations, also belong to the scope of the present invention.

What is claimed is:

1. An audio transducer for changing a signal between an acoustic form and an electrical form, comprising an actuating diaphragm, a stator, and a support for supporting the actuating diaphragm adjacent to the stator, wherein both the actuating diaphragm and the stator comprise transparent material, and the support is arranged to prevent the actuating diaphragm from touching the stator.

2. An audio transducer according to claim 1, wherein the actuating diaphragm is arranged to vibrate in response to an electrical signal interacting with the actuating diaphragm to generate an acoustic response.

3. An audio transducer according to claim 1, wherein the actuating diaphragm is arranged to vibrate in response to an acoustic signal interacting with the actuating diaphragm to generate an electrical response.

4. An audio-visual device comprising an optical device, and an audio transducer for changing a signal between an acoustic form and an electrical form, comprising an actuating diaphragm, a stator, and a support for supporting the actuating diaphragm adjacent to the stator, wherein both the actuating diaphragm and the stator comprise transparent material, and the audio transducer is arranged adjacent to the optical device, and the support is arranged to prevent the actuating diaphragm from touching the stator.

5. An audio transducer according to claim 4, wherein the actuating diaphragm is arranged to vibrate in response to an electrical signal interacting with the actuating diaphragm to generate an acoustic response.

6. An audio transducer according to claim 4, wherein the actuating diaphragm is arranged to vibrate in response to an acoustic signal interacting with the actuating diaphragm to generate an electrical response.

7. An audio-visual device according to claim 4, wherein the stator for the actuating diaphragm comprises a display.

8. An audio-visual device according to claim 4, wherein the actuating diaphragm is located between an outer protective diaphragm and the optical device so as to protect the actuating diaphragm from mechanical damage.

9. An audio-visual device according to claim 8, wherein the outer protective diaphragm is arranged to function as a stator for the actuating diaphragm.

10. An audio-visual device according to claim 4, wherein the audio-visual device comprises an earpiece and a conduit to audiophonically connect the earpiece with the actuating diaphragm.

11. An audio-visual device according to claim 4, wherein the optical device is selected from a group consisting of: a mobile station, a mirror, a window, an electrical display, a solar cell, a touch screen and an illuminator.

12. An audio-visual device according to claim 4, comprising a radio block for radio communication.

* * * * *